US006253759B1

(12) United States Patent
Giebel et al.

(10) Patent No.: US 6,253,759 B1
(45) Date of Patent: Jul. 3, 2001

(54) SIDE BURNER FOR A GRILL

(75) Inventors: Michael Giebel, Joplin; Henry Schubert, Neosho, both of MO (US); Bob Broach, Pella, IA (US); Don Freber, St. Louis, MO (US); Robert Minor, Gilbertsville, KY (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/373,814

(22) Filed: Aug. 13, 1999

(51) Int. Cl.[7] ..... F23Q 14/00

(52) U.S. Cl. ..... 126/39 B; 126/39 E; 126/215; 239/523; 239/559

(58) Field of Search ..... 126/39 R, 39 B, 126/39 E, 152 R, 214 C, 215; 431/264, 266, 349, 354; 239/518, 521, 523, 556, 558, 559, 560

(56) References Cited

U.S. PATENT DOCUMENTS

| | | | | |
|---|---|---|---|---|
| 1,373,788 | | 4/1921 | Ball . | |
| 1,772,407 | * | 8/1930 | Wilhelm | 126/215 |
| 2,530,991 | * | 11/1950 | Reeves | 126/214 C |
| 3,205,933 | * | 9/1965 | Morris | 431/349 |
| 3,385,282 | | 5/1968 | Lloyd . | |
| 3,589,620 | * | 6/1971 | Davis et al. | 239/559 |
| 4,261,327 | * | 4/1981 | Kamin | 126/215 |
| 4,624,240 | | 11/1986 | Hitch . | |
| 4,643,312 | | 2/1987 | Zarges . | |
| 4,747,391 | | 5/1988 | Hanagan et al. . | |
| 4,846,671 | * | 7/1989 | Kwiatek | 431/264 |
| 4,943,232 | * | 7/1990 | Lin | 431/264 |
| 5,603,256 | | 2/1997 | Charlson et al. . | |

FOREIGN PATENT DOCUMENTS

| | | |
|---|---|---|
| 0 332 228 | 12/1992 | (EP) . |

* cited by examiner

*Primary Examiner*—Sara Clarke
(74) *Attorney, Agent, or Firm*—Kramer, Levin, Naftalis & Frankel, LLP.

(57) ABSTRACT

A grill side burner assembly including a burner having a generally disc-shaped body with an oval cross-section. Louvered main ports are arranged around the upper part of the burner body and create a cyclone-like distribution of heat to the cooking surface thereby improving efficiency. A fuel feed channel is formed integrally into a lower portion of the burner and provides fuel to the interior of the burner body. The burner can be attached to the bottom of a bowl-like recess in a side-burner base and covered with a grid. The side burner assembly can be implemented with a very low parts count.

16 Claims, 6 Drawing Sheets

SIDE BURNER FOR A GRILL

FIELD OF THE INVENTION

The present application relates to burners and more specifically to side burners for grills.

BACKGROUND INFORMATION

Propane cooking grills often include side burners for providing an auxiliary heating surface in addition to the main grilling surface. Conventional side burner assemblies, however, can be quite complex, often requiring large numbers of components. For example, a typical side burner assembly includes a base, bowl, facia, lid, burner, grid, valve, valve bracket, knob, electrode and a variety of screws, nuts and washers. Parts counts of 25 or more are typical. Such complexity leads to substantial assembly time, cost, lost parts and reduced reliability.

Known side burner designs can also be inefficient, failing to deliver a substantial portion of the heat generated to the cooking surface. The heat not delivered to the cooking surface is typically dissipated in the base, raising the temperature of the base.

SUMMARY OF THE INVENTION

The present invention provides a burner, which can be used as a side burner of a grill, that overcomes many problems of conventional side burners.

An exemplary embodiment of a side burner assembly in accordance with the present invention comprises a burner base sub-assembly, a grid and a valve. The burner base sub-assembly includes a base and a burner, with the base and burner being staked together. An exemplary embodiment of the burner has a generally circular configuration with a substantially oval cross section. A fuel feed channel extends radially from a lower portion of the burner. An upper portion of the burner comprises a plurality of apertures arranged about a generally cylindrical protrusion at the top of the burner.

Both the base and the burner may be composed of stamped sheet metal, the base preferably of stainless steel and the burner preferably of aluminized or stainless steel. A dual spark electrode may also be arranged proximate to the burner for ignition.

The burner of the present invention has a substantially reduced parts count, leading to reduced assembly time, reduced cost and improved reliability over known burners.

In addition, the burner of the present invention includes a novel arrangement of flame ports which provides improved heat delivery and distribution to the cooking surface, thus also improving efficiency. Comparisons to known burner arrangements show a 25–30% improvement in efficiency. Heat dissipated in the base is substantially reduced, resulting in a cooler base.

DETAILED DESCRIPTION

Figure 1A:
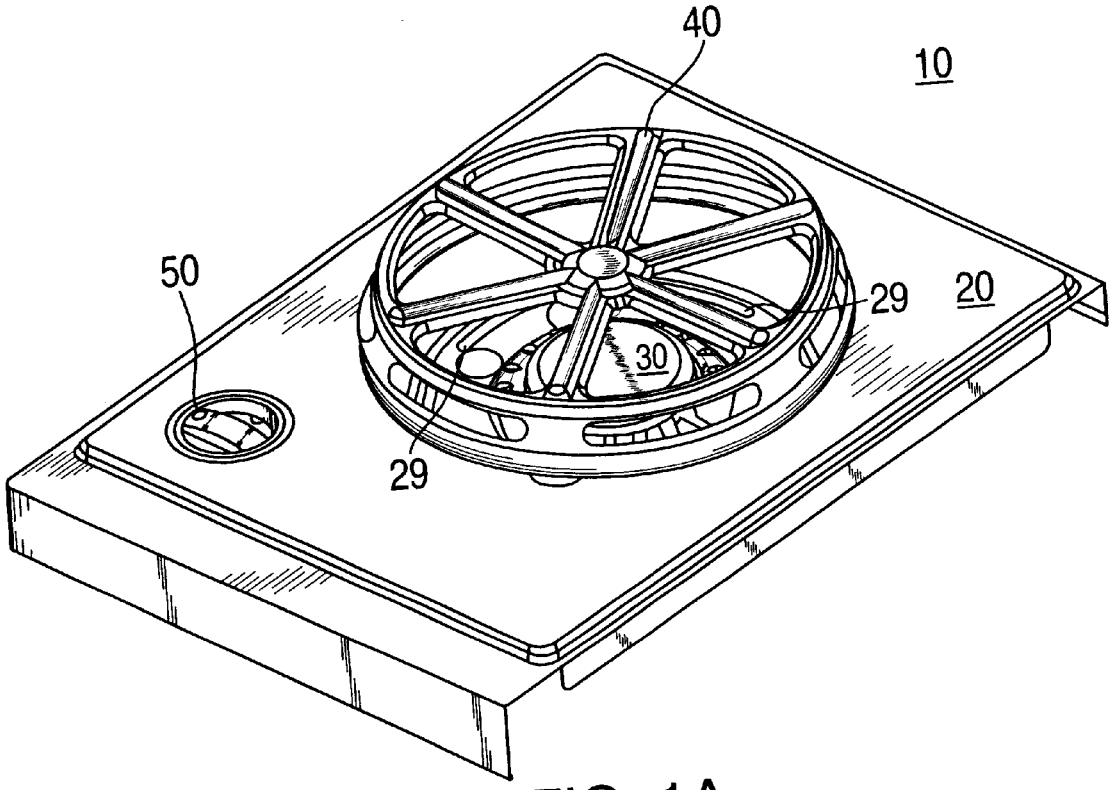
FIGS. 1A and 1B show a perspective view and side view, respectively, of an exemplary embodiment of a side burner assembly in accordance with the present invention.

An exemplary embodiment of a side burner assembly 10 in accordance with the present invention is shown in FIG. 1A in perspective view. The assembly 10 comprises a base 20, a burner 30, a grid 40 and a fuel valve sub-assembly 50.

Figure 1B:
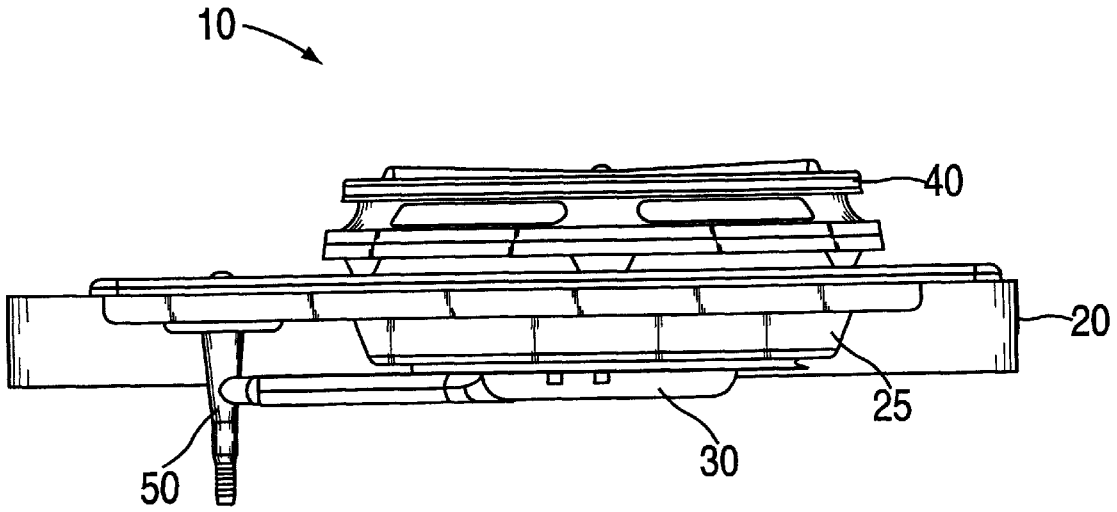
Figure 1C:
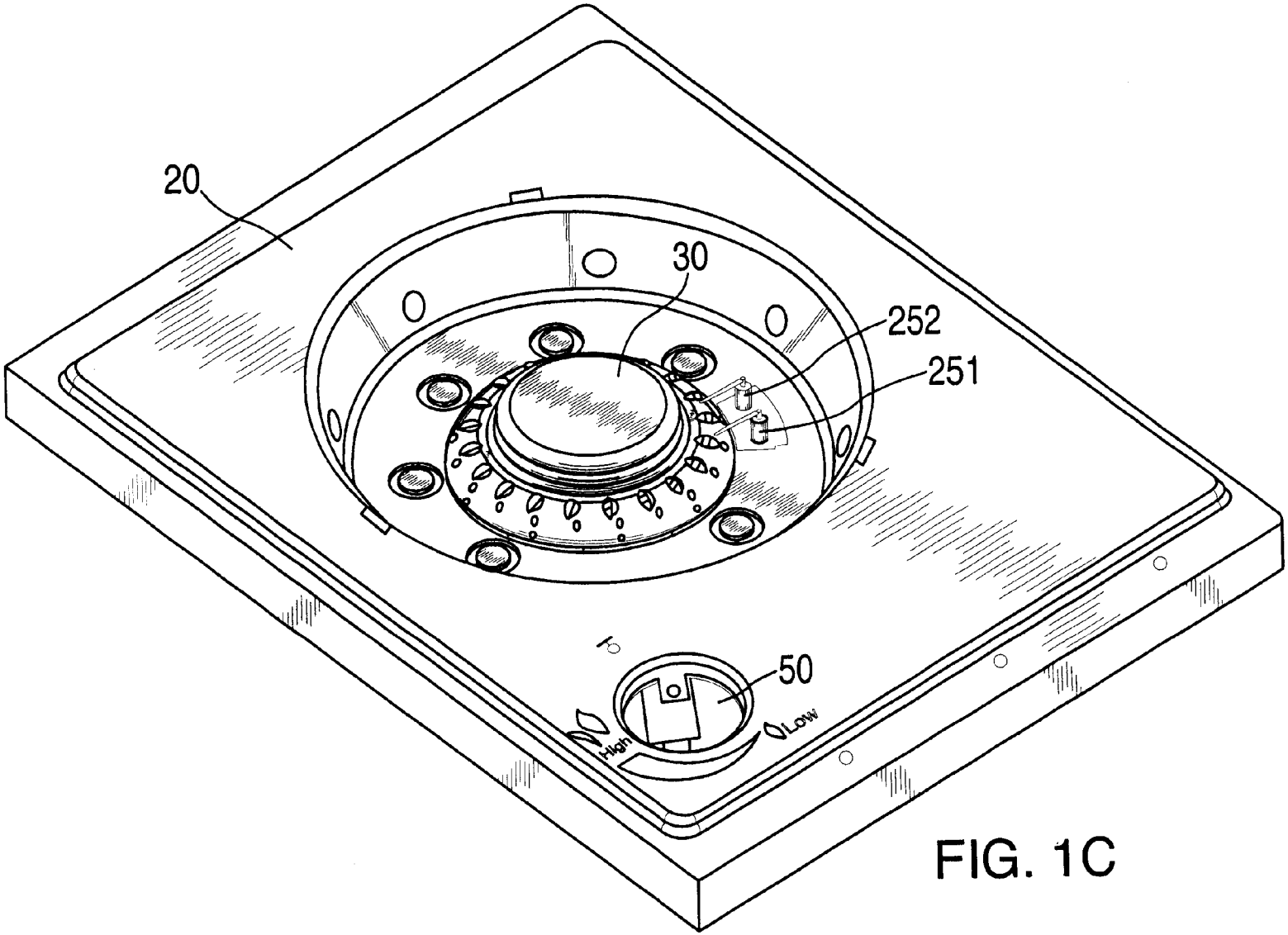
FIG. 1C shows a perspective view of an exemplary embodiment of a side burner assembly with the grid removed.

FIG. 1B shows a side view of the burner assembly 10. The base 20 includes a bowl-like recess 25 with a circular opening in its bottom for receiving a top portion of the burner 30. This arrangement can also be seen in FIG. 1C which shows a perspective view of a side burner assembly 10 with the grid removed. As shown in FIG. 1C, a dual ignitor sub-assembly may be included with two ignitors 251 and 252 arranged proximate to the burner 30. When activated, each ignitor 251, 252 generates a spark between it and the burner 30. The provision of two arcs improves ignition. Moreover, the inclusion of two ignitors provides redundancy, should one of the ignitors fail to operate.

The fuel valve sub-assembly 50 can be implemented using conventional components and can be attached to the base 20 in a conventional manner.

Figure 2A:
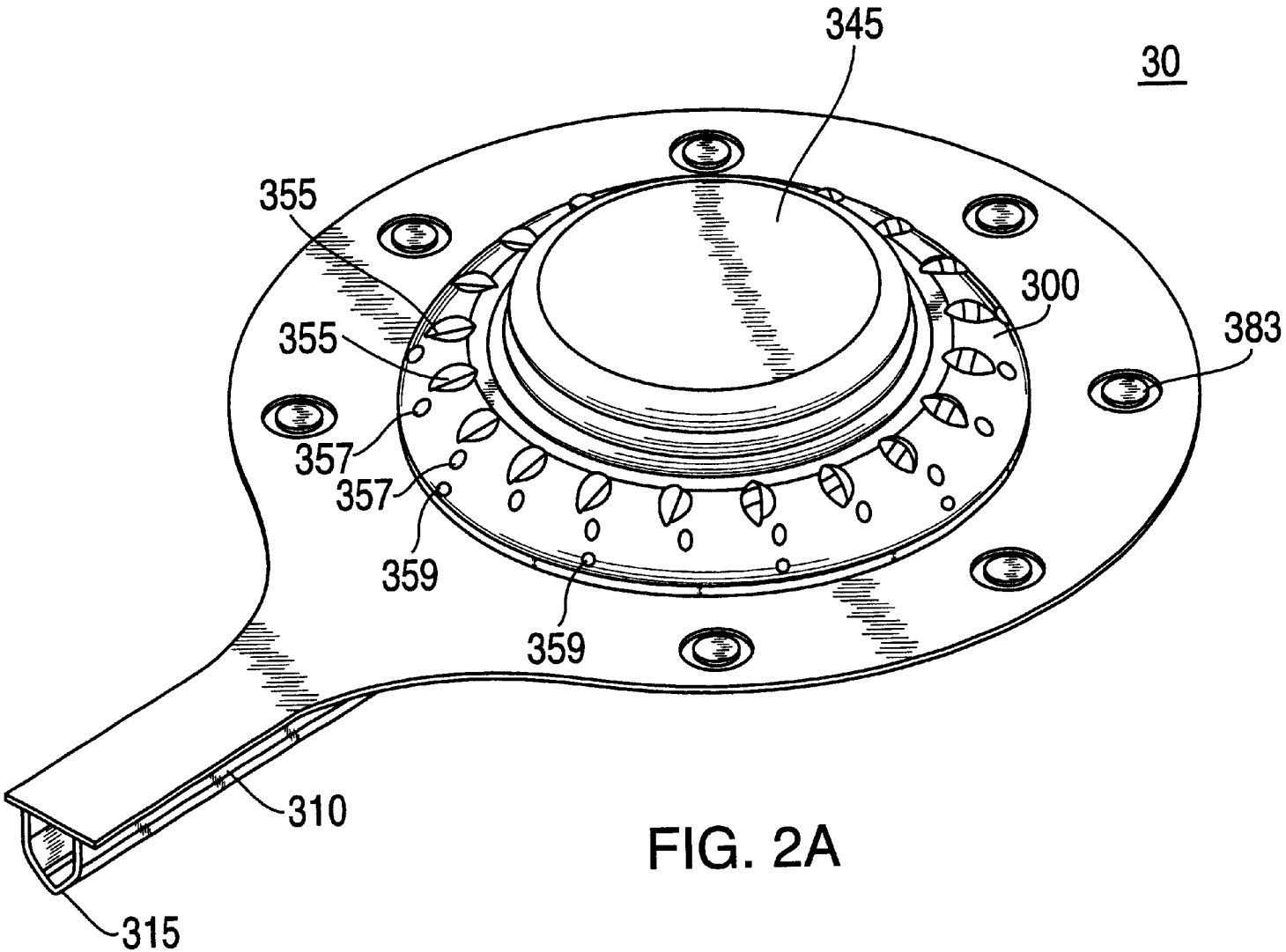
FIGS. 2A and 2B show a perspective view and side view, respectively, of an exemplary embodiment of a burner in accordance with the present invention.
Figure 2B:
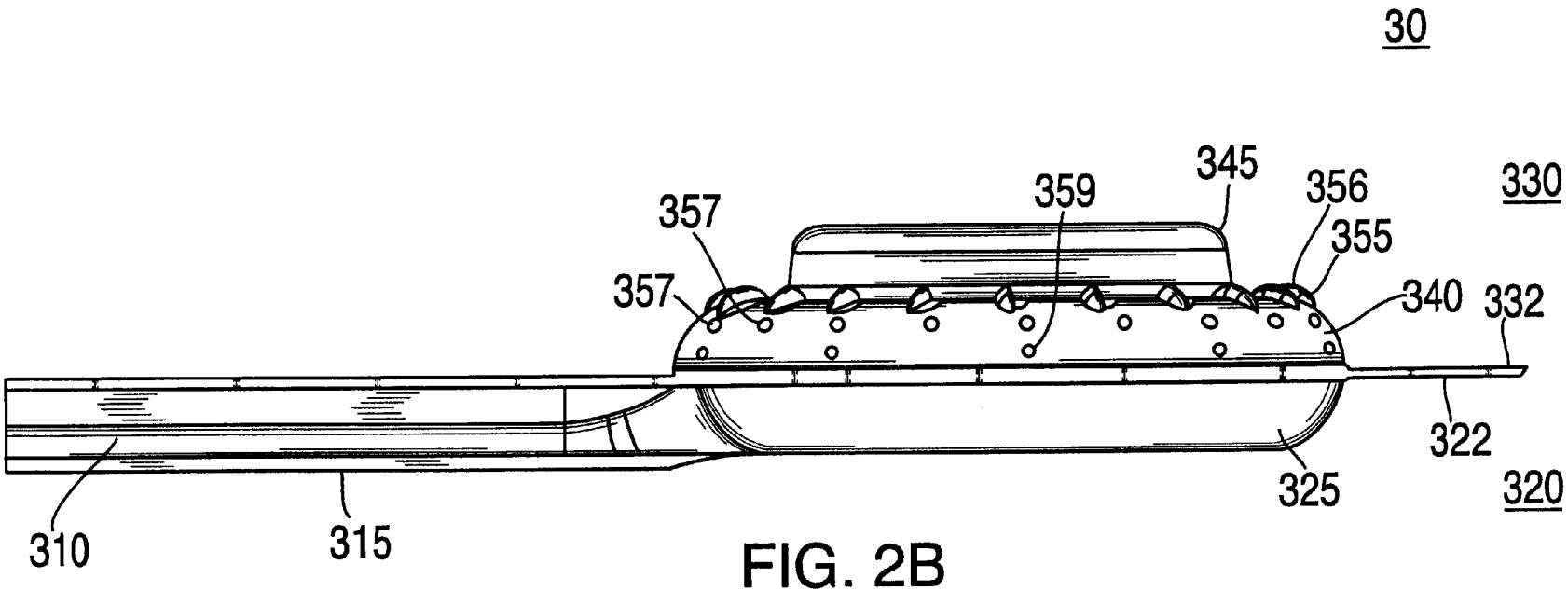

FIG. 2A shows a perspective view of an exemplary embodiment of a burner 30 as used in the assembly 10 of FIGS. 1A and 1B. FIG. 2B shows a side view of the burner 30. As shown in FIGS. 2A and 2B, the burner comprises a generally disc-shaped body 300 with a fuel feed channel 310 extending radially from the body 300. The burner 30 comprises a bottom portion 320 and an upper portion 330 each of which comprises a flange 322 and 332, respectively, by which the two portions are joined such as by welding, hemming or other appropriate joining techniques.

The lower portion 320 of the burner comprises a dish-like recess 325 from which the fuel feed channel 310 extends. The upper portion 330 comprises a dome-like structure 340 whose perimeter substantially matches that of the recess 325 in the lower portion. When the upper and lower portions 330, 320 are joined, the dome-like structure 340 and the dish-like recess 325 form a generally disc-shaped compartment with a generally oval cross-section. Furthermore, upon joining the upper and lower burner portions 320 and 330, the fuel feed channel is enclosed on its top side by the flange of the 332 of the upper portion.

A generally cylindrical projection 345 extends upwards from the top of the dome-like structure 340 of the upper burner portion 330. Proximate to the base of the projection 345, a plurality of apertures or ports 355 are arranged on the dome-like structure 340. The projection 345 helps shield those ports 355 that are downwind from wind that may blow across the burner 30, thus preventing the flame emitted from the burner from being blown out.

In the exemplary embodiment shown, each port 355 comprises a hood-like projection, or louver 356. As shown in FIG. 2A, the louvered ports 355 are spaced radially around the dome-like structure 340 with the louvers 356 pointing in a counter-clockwise direction, as seen from above. The plurality of louvered ports 355 create a cyclone effect which helps direct the heat generated by the burner upwards, to the cooking surface. Each of the louvered ports 355 emits a flame at an angle above horizontal so that the flame emitted does not shoot directly at the flame emitted by the adjacent port. This prevents the flames from joining together as one flame which would impede the cyclone effect.

In the exemplary embodiment shown, below the plurality of louvered ports 355, the dome-like structure 340 comprises a plurality of secondary ports 357. Below the ports 357, a further plurality of secondary ports 359 are included on the dome-like structure 340. The secondary ports 357 and 359 are spaced apart sufficiently to prevent the blending of the individual flames emitted from each port. The secondary ports 357 and 359 provide additional flame-generating capacity for additional heat delivery to the cooking surface. The secondary ports 357 and 359 also act to prevent "lifting" of the flame emitted by the main, louvered ports 355. Furthermore, by being further shielded from wind, due to their arrangement below the main ports 355, the secondary ports 357 and 359 help keep the burner 30 lit in windy conditions.

When assembled, the burner 30 is attached via its joined flanges 332, 322 to the bottom of the recess 25 in the base 20, as shown in FIG. 1B. As shown in FIG. 2A, the flanges 322, 332 comprise mounting holes 383, arranged around the burner body 300, by which the burner 30 can be attached to the base 20, such as by staking, riveting or other appropriate attachment methods. In one such method, the holes 383 receive corresponding embossed cylindrical features (not shown) on the base. Once the burner 30 is seated in the base, the embossed cylindrical features are flattened over the holes 383, thereby capturing the burner between the base and the flattened features.

The bowl-like recess 25 has a circular opening at its bottom for receiving therein the dome-like structure 340 of the burner. As shown in FIG. 1A, arcuate openings 29 concentrically surround the circular opening of the recess 25. The openings 29 provide additional secondary air to the burner ports. The openings 29 also allow any water or moisture that may enter the bowl-like recess 25 to drain. Furthermore, when attached to the base 20, the burner 30 is coupled via the fuel feed channel 310 to a fuel outlet of the valve sub-assembly 50, as shown in FIG. 1B.

As shown in FIGS. 2A and 2B, the fuel feed channel 310 preferably comprises a gutter 315 which runs along the length of the channel 310. The gutter 315 is inclined downward (e.g. 2%) as it extends away from the dish-like recess 325 of the lower portion 320 of the burner. The gutter 315 serves to drain any water or moisture that may be in the burner body 300.

Figure 3:
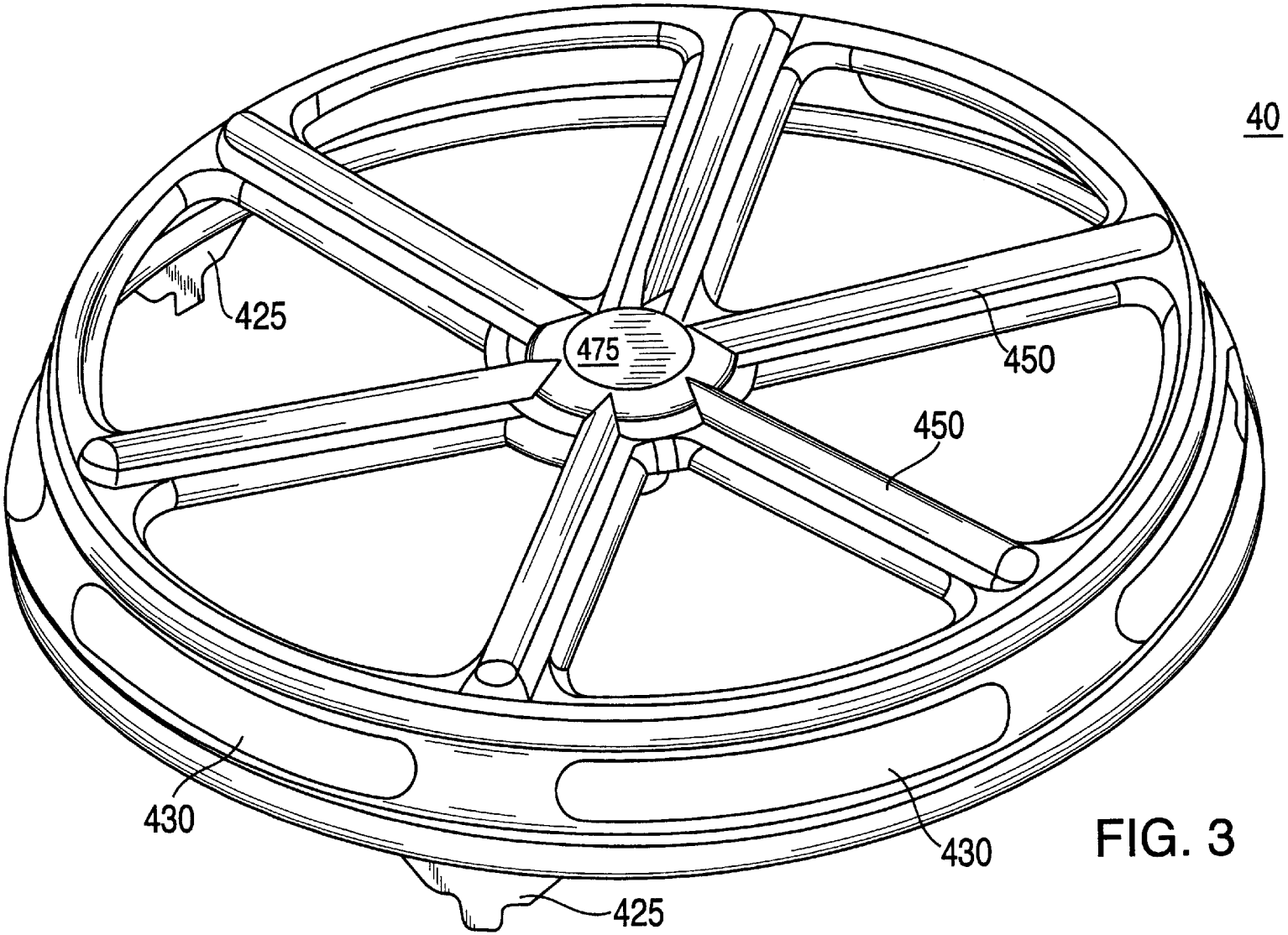
FIG. 3 shows a perspective view of an exemplary embodiment of a burner grid in accordance with the present invention.

FIG. 3 shows, in perspective view, an exemplary embodiment of a grid 40, as used in the exemplary side burner assembly described. The grid 40 is generally in the shape of a truncated cone, with a circular base and a circular top. Tabs 425 are arranged along the perimeter of the base of the grid 40 and are received in corresponding openings in the burner base 20 surrounding the recess 25. The grid 40 is thereby secured against lateral motion over the burner 30, as shown in FIG. 1A. While the grid 40 is thus partially secured to the base, the grid can be readily removed from the base 20 (such as for cleaning) by being lifting upwards. The upper surface of the grid 40 comprises a plurality of spokes 450 extending from a central hub 475. The spokes 450 and the central hub 475 are preferably cupped on their bottom surfaces to promote the retention of heat and for stiffening the overall grid structure. The side wall of the grid 40 acts primarily as a windscreen but includes a plurality of openings 430 which allow exhaust gasses to escape.

The grid 40 can be advantageously formed by being stamped or embossed from a single piece of sheet metal. The stamped sheet metal can then be coated with porcelain using known techniques. The unitary construction of the grid of the present invention provides a much sturdier construction than known grids that are typically constructed by welding several component parts together. The unitary construction is also better suited to porcelain coating, as distortions caused by welding are avoided.

What is claimed is:

1. A burner comprising:

a burner body; and a fuel feed channel, the fuel feed channel being coupled to the burner body for delivering fuel to the burner body, wherein the burner body comprises a plurality of openings arranged on an upper portion of the burner body, wherein the burner body has a substantially circular shape with a substantially oval cross section, and wherein the plurality of openings includes a plurality of louvered ports, each of the plurality of louvered ports having the same orientation.

2. The burner of claim 1, wherein the burner body comprises a lower portion, each of the upper and lower portions comprising a flange for joining the upper and lower portions.

3. The burner of claim 1, wherein the plurality of openings are arranged radially about a center of the burner body.

4. The burner of claim 1, wherein each of the plurality of louvered ports emits a flame which is directed above an adjacent one of the plurality of louvered ports.

5. The burner of claim 1, wherein the fuel feed channel comprises a drainage gutter.

6. A burner assembly comprising:

a base;

a burner, the burner including a burner body and a fuel feed channel, the fuel feed channel being coupled to the burner body for delivering fuel to the burner body, and the burner body including a plurality of openings arranged on an upper portion of the burner body, the burner body having a substantially circular shape with a substantially oval cross section; and a grid, the grid being comprised of stamped sheet metal, wherein the grid comprises a plurality of spokes coupled to a central hub and wherein the spokes and central hub have cupped bottom surfaces, wherein the burner is arranged in the base and the grid is arranged on the base, over the burner.

7. The burner assembly of claim 6 comprising an ignitor sub-assembly.

8. The burner assembly of claim 7, wherein the ignitor sub-assembly includes two ignitors, each generating a spark between itself and the burner body when activated.

9. A burner comprising:

a burner body; and a fuel feed channel, the fuel feed channel being coupled to the burner body for delivering fuel to the burner body, the fuel feed channel comprising a drainage gutter, wherein the burner body comprises a plurality of openings arranged on an upper portion of the burner body, and has a substantially circular shape with a substantially oval cross section.

10. The burner of claim 9, wherein the plurality of openings includes a plurality of louvered ports, each of the plurality of louvered ports having the same orientation.

11. The burner of claim 9, wherein each of the plurality of openings emits a flame which is directed above an adjacent one of the plurality of louvered ports.

12. A burner comprising:

a burner body; and a fuel feed channel, the fuel feed channel being coupled to the burner body for delivering fuel to the burner body, wherein the burner body comprises a plurality of openings arranged on an upper portion of the burner body, wherein the burner body has a substantially circular shape with a substantially oval cross section, and wherein the plurality of openings includes a plurality of louvered ports, each of the plurality of louvered ports having the same rotational orientation.

13. The burner of claim 12, wherein the burner body comprises a lower portion, each of the upper and lower portions comprising a flange for joining the upper and lower portions.

14. The burner of claim 12, wherein the plurality of openings are arranged radially about a center of the burner body.

15. The burner of claim 12, wherein each of the plurality of louvered ports emits a flame which is directed above an adjacent one of the plurality of louvered ports.

16. The burner of claim 12, wherein the fuel feed channel comprises a drainage gutter.

* * * * *